United States Patent [19]

Wagner

[11] Patent Number: 5,003,847

[45] Date of Patent: Apr. 2, 1991

[54] HYDRAULIC POWER WRENCH

[76] Inventor: Paul-Heinz Wagner, Haus Nr. 70, D-5203 Much-Birrenbachshöhe, Fed. Rep. of Germany

[21] Appl. No.: 569,260

[22] Filed: Aug. 15, 1990

Related U.S. Application Data

[63] Continuation of Ser. No. 411,132, Sep. 22, 1989, abandoned.

[30] Foreign Application Priority Data

Oct. 1, 1988 [EP] European Pat. Off. ..... 88116273

[51] Int. Cl.[5] ..... B25B 13/46

[52] U.S. Cl. ..... 81/57.39

[58] Field of Search ..... 81/57.39, 58, 60, 61, 81/177.1, 177.2, 177.85

[56] References Cited

U.S. PATENT DOCUMENTS 4,406,185 9/1983 Junkers ..... 81/57.39
4,619,160 10/1986 Meyer ..... 81/57.39
4,805,496 2/1989 Wagner et al. ..... 81/57.39

FOREIGN PATENT DOCUMENTS 0062195 3/1982 European Pat. Off. .
2914422 10/1980 Fed. Rep. of Germany .
8435272 2/1985 Fed. Rep. of Germany .
3620753 9/1987 Fed. Rep. of Germany .

*Primary Examiner*—D. S. Meislin
*Attorney, Agent, or Firm*—Diller, Ramik & Wight

[57] ABSTRACT

The hydraulic power wrench is provided with a wrench head (10) including a rotatably supported ring member (14) to be connected for rotation with a bolt head. The ring member (14) is driven be a piston (40) accommodated in a cylinder housing (11). Mutual engagement of the wrench head (10) and the cylinder housing (11) is effected by a holding recess (32) and an insert member (33). Thus, the wrench head (10) is connected in such a manner to the cylinder housing (11) that it can be easily detached. The connection is secured by locking members (34). By this arrangement, the wrench head (10) can be selectively combined with different cylinder housings (11).

5 Claims, 3 Drawing Sheets

HYDRAULIC POWER WRENCH

This application is a continuation of application Ser. No. 411,132, filed Sept. 22, 1989.

The invention is directed to a hydraulic power wrench. A hydraulic power wrench as it is known, for example, from German Utility Model 84 35 272, is provided with a wrench held which forms a housing, a ring member being rotatably supported within the walls of said housing. The ring member is engaged by a lever, supported coaxially to the ring member and having a ratched element. The housing of the wrench head is detachably connected to a cylinder housing wherein a piston is displaceably arranged. The end of said piston is connected to the lever by a pulling member so that the piston can entrain the lever in both moving directions. The detachable connection between the housing of the wrench head and the cylinder housing is obtained by inserting the cylinder housing from the outside into a holding recess of the wrench head. From the chamber of the wrench head, i.e. from the interior, a sleeve is screwed into the cylinder housing, which sleeve is supported at a stepped portion of the wrench head and thus prevents extraction of the cylinder housing from the wrench head. In the known power wrench, the wrench head can be used in combination with one of a plurality of selectable cylinder housings. However, mounting of the cylinder housing to the wrench head can be performed only by the manufacturer since, to this purpose, the wrench head must be opened.

European Patent publication 0 062 195 discloses a hydraulic power wrench wherein the ring member, connectable for rotation with the wrench head to be rotated, is connected to the cylinder housing in such a manner that it can be easily detached and exchanged. To this purpose, a longitudinal holding recess is provided at one side of the cylinder housing. A rod-shaped insert piece of the ring member is inserted into said holding recess and locked therein by a pin. In this power wrench, the piston is supported at a stationary abutment portion. There is provided no wrench head having a lever. The detachable connection between the ring member and the cylinder housing is provided for adjusting the ring member and connecting it to the cylinder housing in different positions after termination of the piston stroke, since this power wrench has no ratchet element and thus requires frequent adjustment.

From German Patent publication 36 20 753, there is known a hydraulic power wrench having its cylinder housing firmly welded to the wrench head and having its wrench head provided with a spring which pulls the lever towards the piston and thereby safeguards permanent abutment of the lever to the piston.

It is the object of the invention to provide a hydraulic power wrench wherein the wrench head and/or the cylinder housing can be exchanged in a simple manner and wherein said two parts are of small dimensions and overlap each other only to the absolutely necessary extent.

In the power wrench of the invention, the wrench head and the cylinder housing can be inserted into each other, one of these parts being provided with a holding recess and the other part comprising an insert member to be fitted into said holding recess. The holding recess and the insert member are provided with locking members being arranged in a plane which is substantially parallel to the joint plane. The joint plane is the plane in which the cylinder housing and the wrench head abut each other and which extends laterally to the direction of the piston. A straight line extending through the locking members lies in a plane which extends substantially at a right angle to the direction of the piston. Thereby, it is effected that the holding recess overlaps the insert member only over a comparatively short length and can have a small longitudinal dimension.

It is important that the locking members outside of the accommodating chamber can be guided into the holding recess from the outside, so that it is not necessary to open the wrench head for establishing or releasing the connection to the cylinder housing.

By the fact that the lever is biased in the direction of the piston by a spring, a tractive connection between the lever and the piston can be omitted. A particular advantage consists in that, in the retracted state of the piston, the area where the lever abuts against the piston is arranged in the vicinity of the joint plane and that there are needed no pulling members, engaging over the joint plane, which would have to be loosened or unlocked for separating the cylinder housing from the wrench head. Simultaneously with the introduction of the insert member into the holding recess, the piston is brought into abutment with the biased lever. Thus, a simple linear inserting movement and, if necessary, also a twist of the cylinder housing, are sufficient for the assembling of the wrench head and the cylinder housing, whereas no pivoting or swiveling of the cylinder housing is required. Therefore, the insert process can be performed by a single movement of the hand and without complicated manipulations.

Preferably, the holding recess forms part of the ring member while the insert member is provided at the cylinder housing. Also the reversed arrangement of the holding recess and the insert member is possible, with the holding recess being provided at the cylinder housing and the insert member being provided at the wrench head.

Preferred embodiments of the invention will be explained hereunder in greater detail with reference to the drawings.

In the drawings

Figure 1:
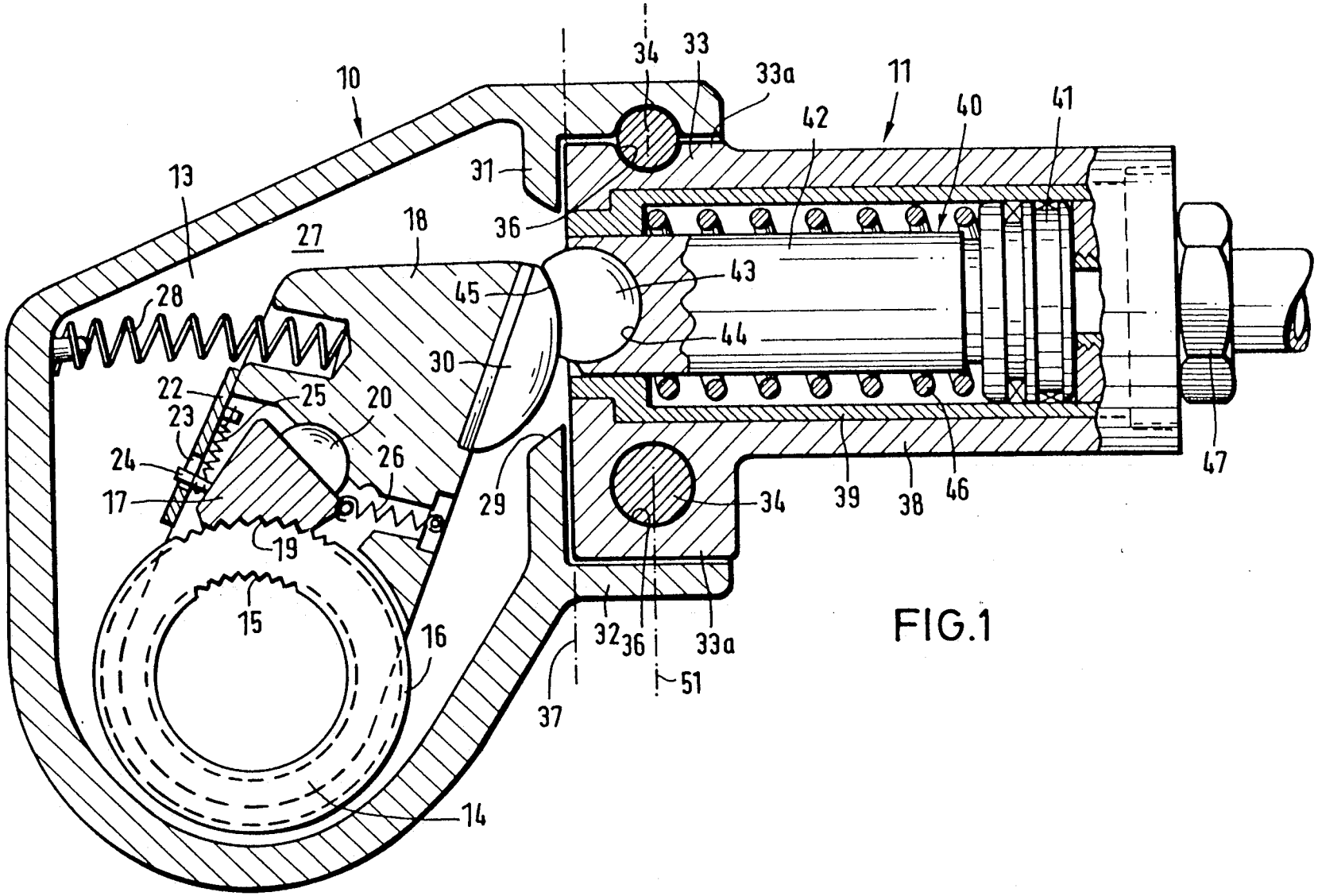
FIG. 1 is a longitudinal section through a first embodiment of the power wrench.
Figure 2:
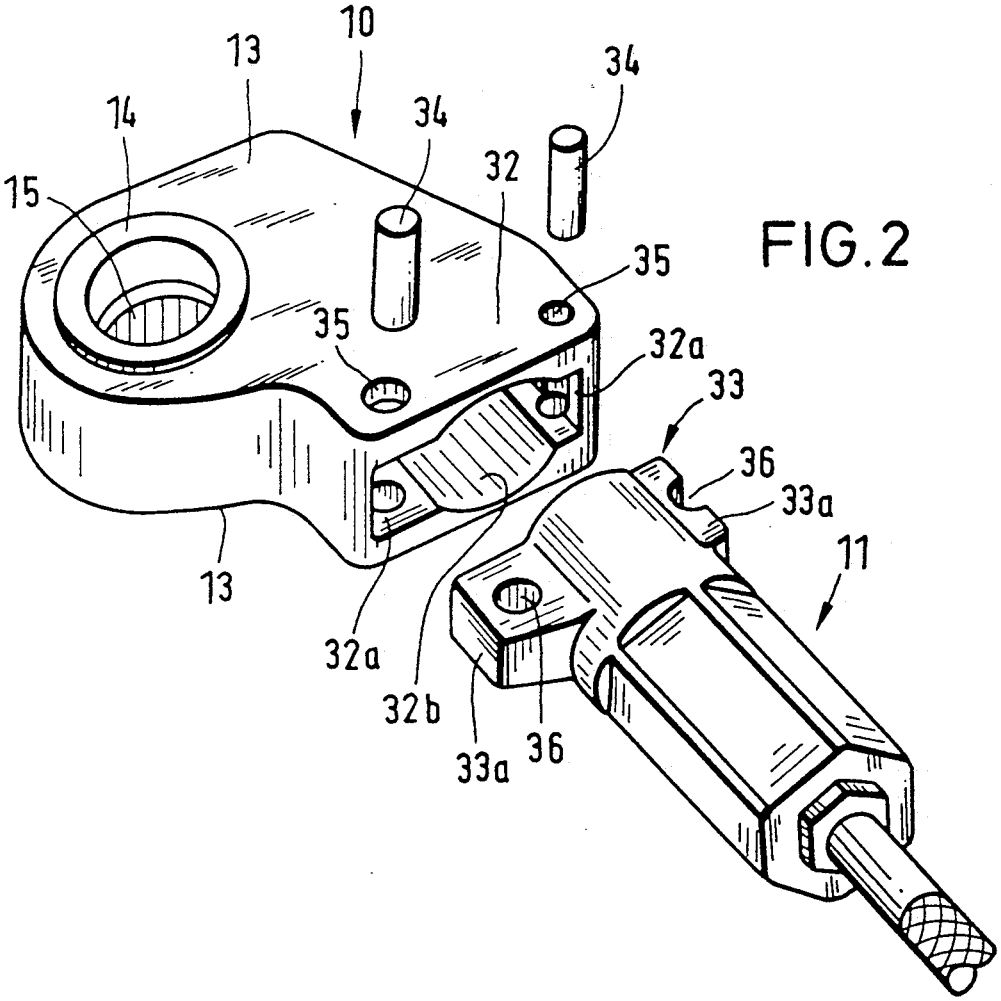
FIG. 2 is a perspective view of the power wrench of FIG. 1 in the released condition.

The power wrench shown in FIGS. 1 and 2 consists of the wrench head 10 and the cylinder housing 11. The wrench head 10 is provided with two parallel end walls 13 having bores for supporting the ring member 14 therein. The ring member 14 has an inner profile 15 into which a shaft (not shown) can be inserted. This shaft is provided with an outer profile which corresponds to inner profile 15. Insertion of the shaft is possible from both sides of wrench head 10. The shaft projects out of wrench head 10 to one or both sides thereof for rotatably driving a bolt head.

A ratchet element 17 (FIG. 1) cooperates with an external toothing 16 of the ring member 14. The ratchet element 17 is a wedge-shaped ratchet shoe arranged in a recess of lever 18. Lever 18 is supported coaxially relative to ring member 14 and is adapted to be swiveled relative to this ring member around the common axis. By a toothing surface 19 of concave arrangement, the ratchet element 17 can engage into the external toothing 16 of ring member 14. The ratchet element 17 has its rear end supported by the plain surface of a hemispherical pressure member 20 which is seated in a spherical recess of lever 18. The ratchet element 17 is freely self-adjustable in all directions to the external toothing 16. The ratchet element 17 is oriented in such a manner that it is lifted off from the external toothing 16 when ring member 14 is moved in one rotating direction so that the ring member is freely rotatable in this direction, whereas the ratchet element 17 blocks the ring member 14 by its toothing when ring member 14 is turned in the opposite direction.

To lever 18, there is fastened a plate 22, covering the recess towards the outside and comprising a guiding slot 23 for a pin 24 protruding from ratchet element 17. Further, a spring 25 is fastened to plate 22 the end of which engages pin 24 and which, accordingly, pulls the outer end of ratchet element 17 along. An additional spring 26, being fastened to lever 18, engages the inner end of ratchet element 17 so as to bring the inner end of toothing surface 19 into engagement with the external toothing 16.

Ring member 14 and lever 18 are arranged in an accommodating chamber 27 of the housing of wrench head 10. One wall of wrench head 10 has a spring 28 supported thereon, pushing against lever 18 and driving it towards an opening 29 of the accommodating chamber 27. The lever 18, at its side facing the opening 29, is provided with a cap-shaped pressure member 30 the outer surface of which forms the pressure surface of lever 18 for engaging the piston. The wall 31, defining the opening 29 and limiting the accommodating chamber 27, is joined by the holding recess 32 of wrench head 10. This holding recess 32 serves for receiving the insert member 33 which is provided at the front end of cylinder housing 11. The insert member 33 has two projections 33*a*, projecting to opposite sides from a cylindrical portion of cylinder housing 11. In a similar manner, the holding recess 32 is provided with two projections 32*a*, projecting to opposite sides from a cylindrical receiving portion 32*b*. The hollow section of holding recess 32 is adapted to the circumferential profile of insert member 33 so that the insert member 33 can fill the cavity of holding recess 32. For locking the cylinder housing 11 to wrench head 10, there are provided locking members 34, formed as cylindrical pins being fitted through corresponding openings 35 of holding recess 32 and suitably adapted openings 36 of the projections 33*a*. The locking members 34 can be easily withdrawn from the openings 35 and 36 in order to detach the cylinder housing 11 from wrench head 10.

The joint plane or plane of relative telescopic insertion 37 between wrench head 10 and cylinder housing 11 is the plane in which the cylinder housing 11 abuts wall 32 and where the cylinder housing 11 joins the wrench head 10. The holding recess 32, overlapping part of cylinder housing 11, is arranged on the cylinder-side of joint plane 37 whereas the rest of wrench head 10 is arranged on the opposite side of the joint plane. The central axes of the locking members 34 are in a plane of locking connection 51 which is substantially parallel to the joint plane 37, the holding recess 32 projecting only over a small portion of the front end of cylinder housing 11.

The cylinder housing 11 has an outer casing 38, formed integral with insert member 33 and providing protection against bursting of the device. Within casing 38, the hydraulic cylinder 39 is arranged for movably guiding the piston 40 therein. The piston consists of the piston body 41 and the piston rod 42 projecting from piston body 41. The piston rod 42 has its front end provided with a pressure member 43. Said pressure member 43 is supported in a spherical recess 44 of piston rod 42 and has a concave spherical surface 45. The curvature of this spherical surface 45 is adapted to the convex curvature of pressure member 30. Under the action of spring 28, pressure member 30 is forced against pressure member 43 so that lever 18 is kept in abutment with the piston 40.

The piston rod 42 is surrounded by a spring 46 driving the piston 40 into its retracted position. At the rear end of cylinder housing 11, a hydraulic connection 47 is arranged through which the cylinder 39 can be pressurized so as to move piston 40 in the direction of lever 18. Reverse motion of the piston is performed by spring 46 upon termination of the hydraulic pressure.

When the piston body 41 is pressurized, piston 40 is moved forward. Thereby, lever 18 is pivoted against the action of spring 28, and, cooperating with the ratchet element 17, carries the ring member 14 along. In this manner, rotation of the screw coupled to ring member 14 is effected.

Upon termination of the hydraulic pressure, piston 40 is moved back while the ratchet element 17 slides over the external toothing 16 without pulling the ring member along.

In the retracted position, the end of piston 40 is flush with the front end of cylinder housing 11 so that only the pressure member 43 slightly projects from out of this cylinder housing. When the cylinder housing 11 is slidingly moved into holding recess 32, pressure member 43 abuts against pressure member 30, causing a slight compression of spring 28. In this condition, the locking members 34 can be introduced into the openings 35 and 36. Then, the power wrench is ready for use.

Figure 3:
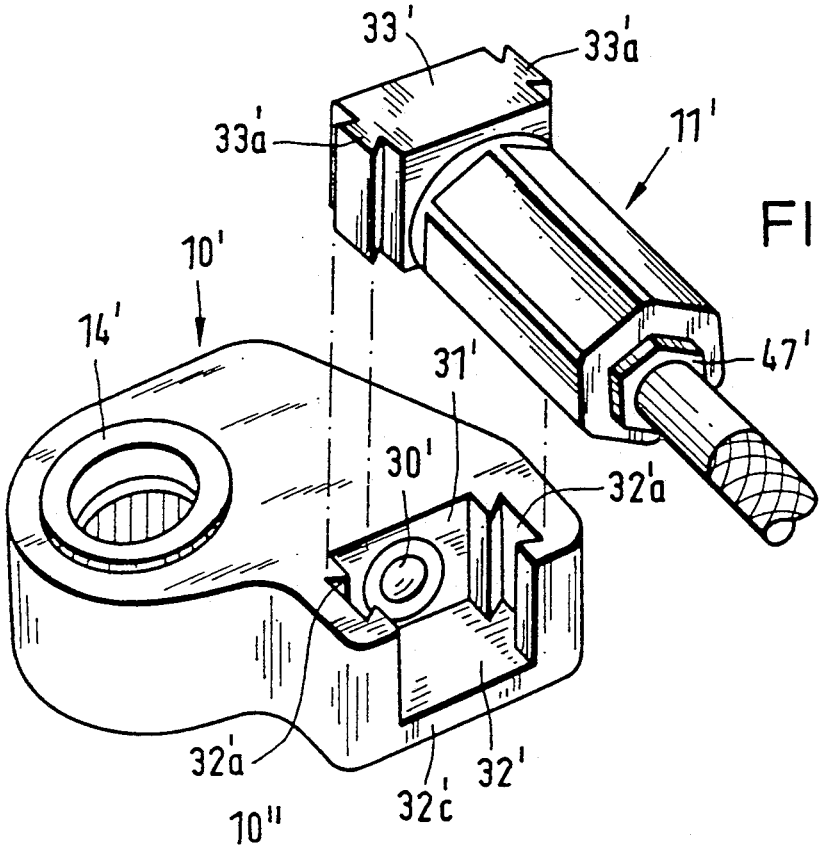
FIG. 3 shows a second embodiment wherein the assembling of the wrench head and the cylinder housing is performed by lateral insertion.

In the embodiment of FIG. 3, the holding recess 32' consists of a laterally open hollow section into which the insert member 33' can be inserted laterally to the direction of the piston. The projections 33'*a* of insert member 33' and the hollow projections 32'*a* of holding recess 32' are provided as dovetail profiles; however, they can also be arranged as rectangular bar profiles. At the side opposite to the open side, the holding recess 32' is provided with a wall 32'*c* limiting the lateral insertion of insert member 33'. The projections 33'*a* also act as locking members for preventing axial removal of cylinder housing 11 from wrench head 10'.

Figure 4:
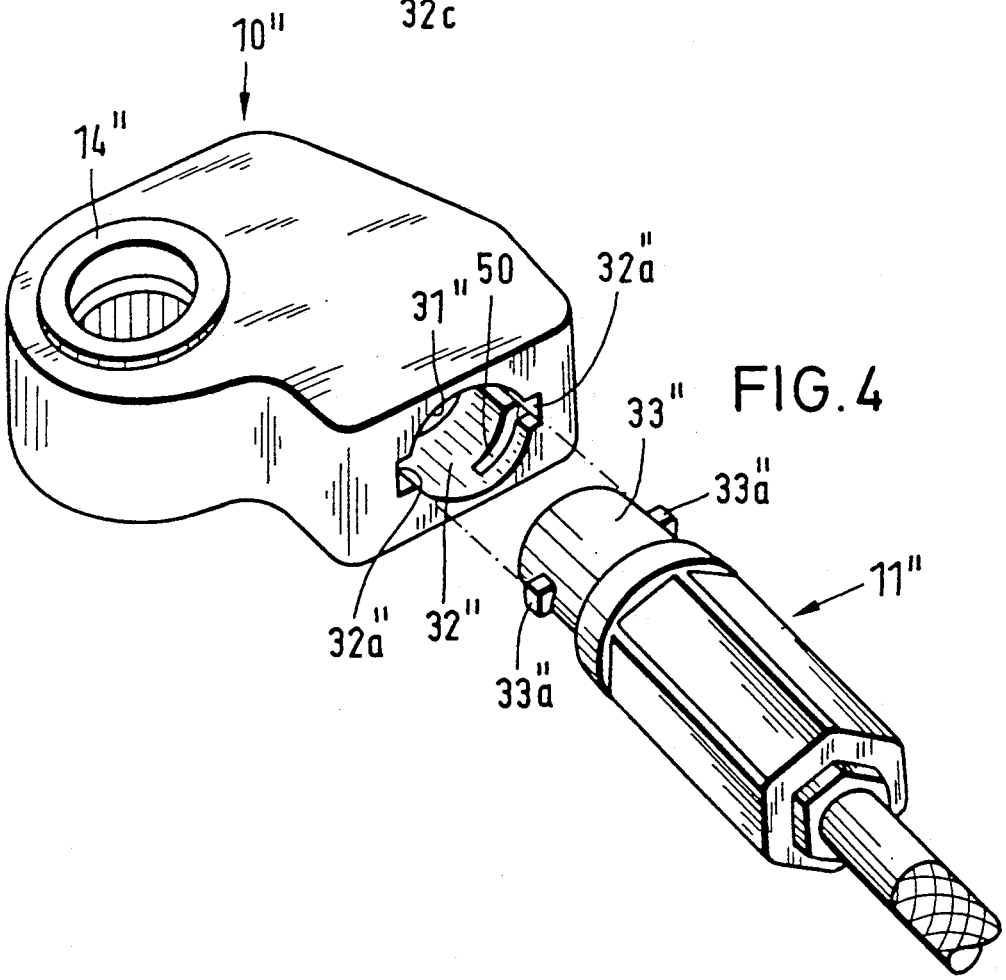
FIG. 4 shows a fourth embodiment being provided with a bayonet catch.

In the embodiment of FIG. 4, the coupling between wrench head 10'' and cylinder housing 11'' is arranged as a bayonet catch. Holding recess 22'' and insert member 33'' are substantially cylindrical. The projections 33*a*, projecting to opposite sides from the body of insert member 33'' are inserted into projections 32''*a* of holding recess 32''. Grooves 50, starting from the projections 32''*a*, extend in circumferential direction of holding recess 32''*a*. When the insert member 33'' has been advanced to the wall 31'' and has been twisted subsequently, the projections 33''*a* enter the area of the grooves 50. thus locking the cylinder housing 11'' to the wrench head 10'' in the manner of a quick-acting lock.

Also in this embodiment, the projections 33" serve as locking members.

The invention allows selective combinations of different cylinder housings and different wrench heads as well as quick exchange of these members, the only precondition being that the holding recesses and the insert member are adapted to each other.

I claim:

1. A hydraulic power wrench comprising a wrench head, said wrench head having a chamber and a connecting portion, a rotatable ring member housed in said chamber, lever means having a first end portion in driving relationship to said ring member for imparting rotation thereto, a cylinder housing, said cylinder housing including a fluid motor including movable member means movable along a longitudinal axis thereof for imparting motion to a second end portion of said lever means, said cylinder housing having a connecting portion, said connecting portions being in generally telescopic interconnected relationship to each other, said connecting portions have cooperative male and female locking means for selectively coupling and uncoupling said wrench head and cylinder housing, said cylinder housing and wrench head connecting portions defining a plane of relative telescopic insertion which is transverse to the longitudinal axis of said movable member means, said male and female locking means defining a plane of locking connection which is transverse to the longitudinal axis of said movable member means, said telescopic insertion plane being disposed generally between said locking connection plane and said lever means, said telescopic insertion plane and locking connection plane being in general parallel relationship to each other, said male and female locking means including first and second locking portions carried by respective ones of said connecting portions, said first locking portion including at least one slot having a longitudinal axis, said second locking portion including at least one projection having a longitudinal axis and being slidably received in said slot, said longitudinal axis of said at least one slot and of said at least one projection lying generally transverse to the longitudinal axis of said movable member means.

2. The hydraulic power wrench as defined in claim 1 wherein said first locking portion includes a second slot disposed in opposed opening relationship to said one slot, and said second locking portion further includes a second projection slidably received in said second slot.

3. The hydraulic power wrench as defined in claim 1 wherein said one slot and one projection are relative slidable in generally parallel relationship to said telescopic insertion and the locking connection planes.

4. The hydraulic power wrench as defined in claim 2 where said slots and the projections are relatively slidable in generally parallel relationship to said telescopic insertion and locking connection planes.

5. A hydraulic power wrench comprising a wrench head, said wrench head having a chamber and a connecting portion, a rotatable ring member housed in said chamber, lever means having a first end portion in driving relationship to said ring member for imparting rotation thereto, a cylinder housing, said cylinder housing including a fluid motor including movable member means for imparting motion to a second end portion of said lever means, said cylinder housing having a connecting portion, said connecting portions being in generally telescopic interconnected relationship to each other, said connecting portions have cooperative male and female locking means for selectively coupling and uncoupling said wrench head and cylinder, said cylinder housing and wrench head connecting portions defining a plane of relative telescopic insertion which is transverse to the direction of movement of said movable member means, said male and female locking means defining a plane of locking connection which is transverse to the direction of movement of said movable member means, said telescopic insertion plane being disposed generally between said locking connection plane and said lever means, said telescopic insertion plane and locking connection plane being in general parallel relationship to each other, said male and female locking means including first and second locking portions carried by respective ones of said connecting portions, said first locking portion including at least one slot, said second locking portion including at least one projection slidably received in said one slot by sliding movement in the direction of movement of said movable member means, and further locking means securing said one projection to said wrench head connecting portion.

* * * * *